US005350626A

United States Patent [19]

Groshens et al.

[11] Patent Number: 5,350,626

[45] Date of Patent: Sep. 27, 1994

[54] TEXTILE BASE MATERIAL FOR THERMOBONDING INTERLINING COMPRISING IN WEFT YARNS TEXTURIZED BY AIR JET

[75] Inventors: Pierre Groshens, Peronne; Fabrice Covet, Roisel, both of France

[73] Assignee: Lainiere de Picardie S.A., France

[21] Appl. No.: 78,620

[22] Filed: Jun. 17, 1993

[30] Foreign Application Priority Data

Jul. 6, 1992 [FR] France ..... 92 08952

[51] Int. Cl.[5] ..... D03D 15/08; D04B 1/16; D04B 1/18; D04B 1/20

[52] U.S. Cl. ..... 428/229; 2/272; 66/172 E; 66/202; 139/421; 428/231

[58] Field of Search ..... 428/229, 231; 139/421; 66/172 E, 202

[56] References Cited

U.S. PATENT DOCUMENTS

| | | | |
|---|---|---|---|
| 3,410,076 | 11/1968 | Dyer . | |
| 4,000,551 | 1/1977 | Holden | 28/72.12 |
| 4,069,657 | 1/1978 | Bascom . | |
| 4,081,887 | 4/1978 | Holden | 28/271 |
| 4,248,036 | 2/1981 | Barron | 57/226 |
| 4,319,447 | 3/1982 | Du Pont DeNemours . | |
| 4,692,365 | 9/1987 | Akzo . | |

*Primary Examiner*—James C. Cannon
*Attorney, Agent, or Firm*—Ladas & Parry

[57] ABSTRACT

This invention relates to a base material for thermobonding interlining, constituted by a fabric or a weft knit of which at least the weft is made of synthetic yarns of large voluminosity, obtained by the air-jet texturization technique from at least two multi-filament yarns, namely a first core yarn for 20 to 40% by weight and a second effect yarn for 60 to 80% by weight, the overfeeding of the core yarn being included between 10 and 25% and overfeeding of the effect yarn at least 70%.

6 Claims, 1 Drawing Sheet

TEXTILE BASE MATERIAL FOR THERMOBONDING INTERLINING COMPRISING IN WEFT YARNS TEXTURIZED BY AIR JET

FIELD OF THE INVENTION

The present invention relates to a textile base material intended for interlining garment pieces, particularly intended for constituting a thermobinding interlining by deposition of thermofusible polymers on its surface.

BACKGROUND OF THE INVENTION

Among the base materials for thermobinding interlining, there are distinguished, on the one hand, the textile base materials proper and, on the other hand, the nonwovens. The textile base materials proper are obtained by weaving or knitting yarns, whilst the nonwovens are obtained by constituting and consolidating a web of fibers or filaments.

For making textile base materials intended for interlining fine, light cloth, for example shirts, dresses or light jackets, texturized synthetic yarns have already been used, obtained by the set false twist process. This limitation to fine, light cloths is due to the small volume and to the smooth surface resulting from the slight crimp of the texturized continuous filaments obtained by this technique of texturization. Furthermore, to give such textile base materials the touch necessary for the interlining, it is necessary to subject them to treatments of shrinking and thermofixing after weaving or knitting, in order to reveal the crimp of the filaments.

The effect of such shrinking and thermofixing treatments is to increase the volume of the textile support and thus to modify its touch. This necessitates producing, by weaving or knitting, a textile base material which presents a width 15 to 30% greater than that obtained after the shrinking and thermofixing treatments. It is therefore necessary to employ looms making it possible to work at a greater width.

Moreover, the textile base material thus shrunk presents a residual extensibility which is close to the shrinkage rate. This extensibility may be detrimental to the undeformability of the garment when worn, since the interlining is not in a position to stabilize the garment piece when the latter is itself extensible, for example when it is question of a stitched article.

Furthermore, in the domain of thermobonding interlining, it is desired that the textile base material has a very good covering power, so that the deposits of thermofusible polymer made on the surface of said base material do not penetrate thereinside, such a penetration has for effect locally to rigidify said interlining and consequently the garment piece. With equal interlining weight, the polymer penetrates with greater difficulty as the surface of the base material is closed, i.e. there is a reduced space between the different fibers or filaments which constitute the base material. The more this space is reduced, the more the base material has a great covering power. Structurally, at equal weight, the nonwoven interlining base material has a much greater covering power than the textile base material proper.

However, the nonwoven lacks voluminosity to constitute a thermobonding interlining acceptable in many applications.

It is an object of the present invention to propose a textile base material for thermobonding interlining which presents a covering power similar to that of a nonwoven and which does not present the above-mentioned drawbacks of the textile base material comprising texturized yarns obtained by the set false twist process.

SUMMARY OF THE INVENTION

This object is perfectly attained by the base material for thermobonding interlining according to the invention. This base material is of the textile base material type in that it is constituted by a fabric or a weft knitted fabric. In known manner, it comprises texturized synthetic yarns. In characteristic manner, at least the weft of the fabric or of the weft knitted fabric is made of synthetic yarns of large voluminosity, obtained by the air-jet texturization technique from at least two multifilament yarns, namely a first core yarn for 20 to 40% by weight and a second effect yarn for 60 to 80% by weight, the overfeeding of the core yarn being included between 10 and 25% and overfeeding of the effect yarn at least 70%.

Applicants have ascertained that, under the specific conditions set forth above, the textile base material for thermobonding interlining presented an excellent covering power, a touch comparable with a base material made from spun yarns of fibers, and a very great voluminosity.

It is true that the technique of air jet texturization with core yarn and effect yarn has already been known for a long time. Such a technique is for example described in document FR-A-2 450 891. However, to Applicants' knowledge, no textile base material for thermobonding interlining has been proposed with, as constituent yarns, texturized synthetic yarns, with great voluminosity obtained by the air jet texturization technique employing two multifilament yarns, with overfeeding. In fact, under normal conditions of implementation of this technique, i.e. for the other applications, the yarn obtained does not contribute the qualities desired for an optimum interlining.

The textile base material being a weft knitted fabric, the percentage by weight of weft yarn with respect to the warp yarn is preferably at least 80%. In this case, it is noted that the cover rate of the textile base material obtained is very clearly higher than that obtained when a weft yarn is employed which is a spun yarn of fibers of the same count, in replacement of the yarn texturized by air jet according to the invention.

According to a particular embodiment of the invention, the multi-filament yarn corresponding to the core yarn is a yarn presenting a certain extensibility. The purpose of this is to give the textile base material for thermobonding interlining a residual extensibility which is close to that obtained with textile base materials woven or knitted from spun yarns of fibers. In fact, although a considerable extensibility of the textile base materials for thermobonding interlining is redhibitory as it does not enable fine cloths, themselves extensible, to be stabilized, nonetheless it is desirable that said base materials present a certain extensibility so as to preserve the suppleness of the garment.

The extensibility in question is preferably of the order of 10 to 15%.

This is obtained by employing, in the textile base material according to the invention, texturized core yarns obtained conventionally by the false twist technique. In this way, the yarn texturized by air jet obtained presents the residual elasticity corresponding to this tensioning.

According to another embodiment, the extensibility of the weft yarn is obtained by employing in the core yarn filaments based on elastothane. Despite the presence of the loops made around the core yarn by the effect yarn, the weft yarn conserves a part of the extensibility of the core yarn.

The filaments of the effect yarn advantageously present a unitary count included between 1 and 3 decitex. This range of count avoids the drawbacks of too fine filaments and those of too thick filaments. Concerning too fine filaments, there may be a flattening of the filaments during application of the polymer spots on the textile base material for making the thermobonding interlining. As to the use of filaments in the effect yarn of a count higher than 3 decitex, it is detrimental to obtaining a high cover rate for a base material of determined GSM.

BRIEF DESCRIPTION OF THE DRAWINGS

The invention will be more readily understood on reading the following description of an embodiment of a textile base material for thermobonding interlining of which at least the weft is made of synthetic yarns of high voluminosity obtained by air jet texturization, with reference to the accompanying drawings, in which:

The single FIGURE schematically represents the process of manufacturing a weft yarn by air jet texturization.

DETAILED DESCRIPTION OF THE DRAWINGS

Figure 1:
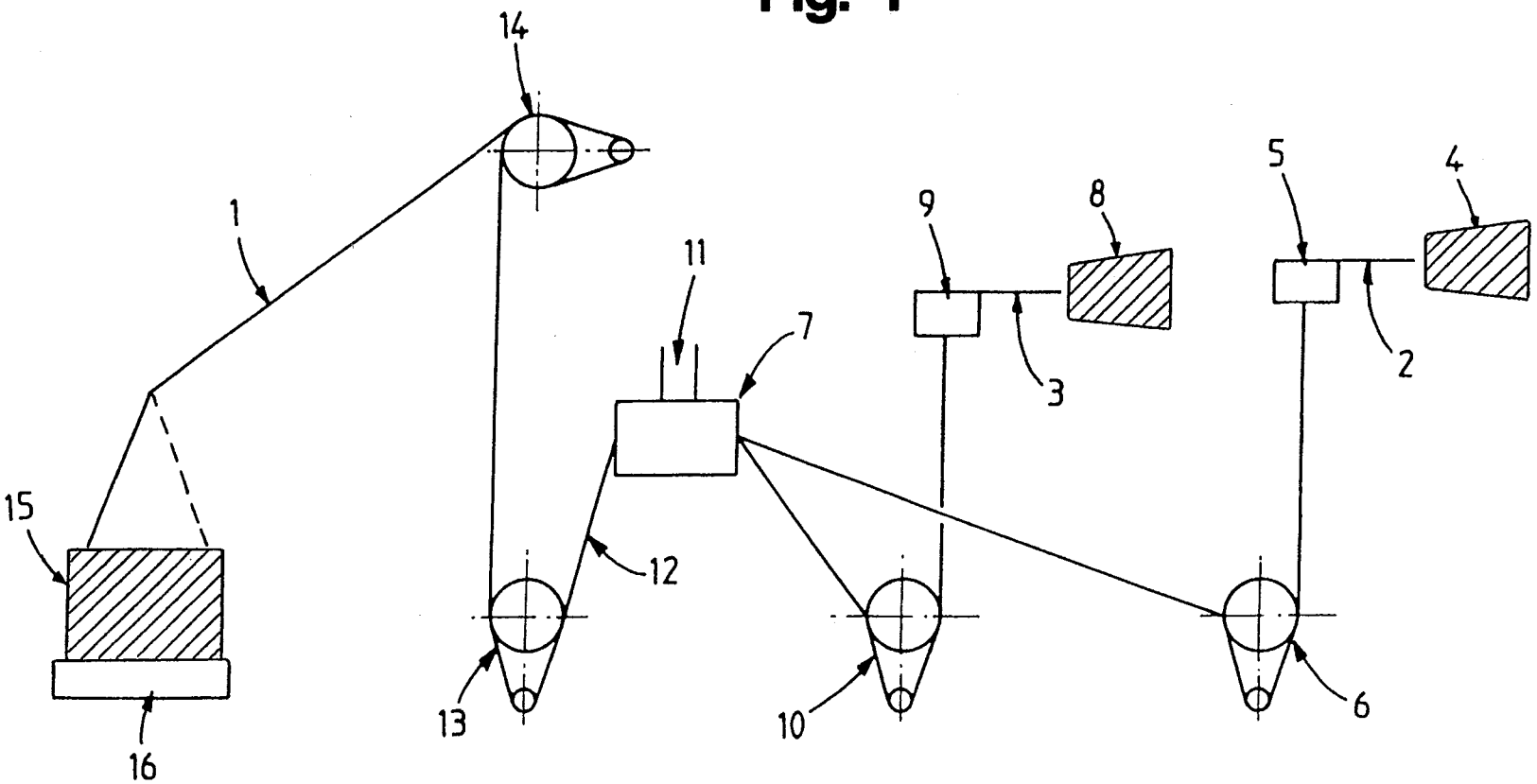

According to the invention, the thermobonding interlining is constituted by a textile base material, i.e. a fabric or a weft knit of which at least the weft yarns are synthetic yarns texturized by the technique of air jet texturization from at least two multifilament yarns, namely a first so-called core yarn for 20 to 40% by weight and a second so-called effect yarn for 60 to 80% by weight; moreover, during manufacture of this weft yarn, the overfeed of the core yarn is included between 10 and 25% and the overfeed of the effect yarn at least 70%.

Although such a texturized yarn may be used not only in weft but also in warp, such a yarn will, for simplification, be designated in the present specification by weft yarn.

Referring now to the drawing, the FIGURE schematically represents the process for manufacturing a weft yarn 1, which is therefore a texturized synthetic yarn responding to the parameters mentioned above.

This weft yarn 1 is constituted by the assembling of two multi-filament yarns: a first, so-called core yarn 2 and a second, so-called effect yarn 3.

The core yarn 2 is unwound from a reel 4, passes through a tensioning device 5 and is wound in several turns around a feed roller 6 before penetrating in the texturization nozzle 7. The effect yarn 3 follows a similar path: it is unwound from reel 8, passes through the tensioning system 9, is wound in several turns around the feed roller 10 and penetrates at the same time as the core yarn 2 in the texturization nozzle 7. The core yarn 2 preferably passes in a wetting system (not shown) before penetrating in the nozzle 7.

The texturization nozzle 7 is supplied with compressed air via the channel 11 from a source (not shown). The yarn 12 leaving the texturization nozzle 7 passes over a first roller 13 then a second intermediate roller 14 around which it is wound in several turns then the weft yarn 1 obtained is received in the form of a reel 15 driven by friction thanks to the reception roller 16.

According to the principle of texturization by air jet, the peripheral speed of the supply rollers 6 and 10 respectively of the core yarn 2 and of the effect yarn 3 is greater than the peripheral speed of the first intermediate roller 13.

The overfeed rate of the core yarn must, according to the invention, be included between 10 and 25%. This means that the peripheral speed of the supply roller 6 will be greater by 10 to 25% than the peripheral speed of the winding of the weft yarn 1 on the first intermediate roller 13. Similarly, concerning the effect yarn, the overfeed rate must, according to the invention, be at least 70%. This means that the peripheral speed of the supply roller 10 will be greater by 70% than the speed of winding of the weft yarn 1 on the first intermediate roller 13.

The second intermediate roller 14 serves to regulate the tension of the weft yarn 1. It may have a peripheral speed slightly greater than that of the first intermediate roller 13.

The peripheral speed of the reception roller 16 may be higher or lower than that of the first intermediate roller 13. A peripheral speed of the first intermediate roller 13 lower than that of the reception roller 16 is in particular chosen when it is desired that the core yarn 2 be, in the weft yarn 1, in a substantially stretched state, without excessive formation of loops on said core yarn.

The peripheral speed of the first intermediate roller 13 defines with respect to the peripheral speeds of the respective supply rollers 6 and 10, the overfeeds of the core yarns 2 and effect yarns 3 during passage thereof in the texturization nozzle 7. The flow of compressed air, supplied by conduit 11, penetrates in the inner chamber of the texturization nozzle 7 and encounters the core yarns 2 and effect yarns 3. The eddying effect provoked inside this chamber by the compressed air causes the filaments of the core yarns 2 and effect yarns 3 to mingle thoroughly, with the result that loops are formed from the filaments of the effect yarn 3 which are inserted and blocked by the filaments of the core yarn 2. It will be understood that the overfeed rate of the effect yarn influences the effect of looping obtained. The overfeed of the core yarn 2 enables the filaments thereof to be opened, so that the filaments of the effect yarn 3 may, under the effect of the compressed air, penetrate between the unitary filaments of the core yarn 2.

In the case of the core yarn 2 and/or the effect yarn 3 being yarns of the POY type, i.e. yarns having undergone during spinning only a pre-drafting, the installation which has just been described also comprises, between the tensioning device 5 or 9 and the texturization nozzle 7, a drafting system comprising two supply rollers with the downstream roller which rotates at a peripheral speed greater than that of the upstream roller and which, being heating, effects thermofixing of the yarn. The overfeed of the core yarn and of the effect yarn according to the invention must be included as being defined from the peripheral speeds of the downstream roller of the drafting system and of the first intermediate roller.

According to the technique which has just been described, a weft yarn 1 has been made, having a count of 360 decitex, comprising a proportion of 30% by weight of core yarn and 70% by weight of effect yarn. The core yarn 2 is a multi-filament yarn of 170 dtex, 72 strands of POY type, each multi-filament making 2.36 dtex; the effect yarn is a multi-filament yarn of 170 dtex, 72 strands of POY type, each filament making 2.36 dtex. The core and effect yarns 2, 3 are drafted in the drafting system until a count of 100 dtex is attained. This weft yarn 1 is obtained with an overfeed of the core yarn of 11% and an overfeed of the effect yarn of 170%.

This weft yarn 1 is used in the manufacture of a weft knit for thermobonding interlining in which the weft represents 80% of the total weight of the knit.

Comparatively, a weft knit is made, having the same structure and the same weft length, employing as weft yarn a spun yarn of fibers of the same count obtained according to the so-called open end spinning technique.

It will be noted that the knit obtained with the synthetic weft yarn texturized by air jet presents a cover rate much higher than that obtained with the spun yarn of fibers. The same applies to the comparison of the thicknesses of the two knits. The difference observed is more than the double. More precisely, the measurement of the thickness obtained with the aid of the apparatus marketed by the firm SODEMAT was 0.77 mm for the weft knit according to the invention and 0.33 mm for the weft knit with the open end yarn.

Of course, being question of the weft knit obtained with a spun yarn of fibers in weft, it is conventional to subject it to treatments, particularly napping, intended to cause the surface fibers to emerge. Even after napping, it is noted that the weft knit with spun yarn of fibers has a cover rate which is less than that of the weft knit according to the invention. In fact, the loops of the texturized yarns with high voluminosity obturate the spaces between the stitches of the weft knit much more than the napped fibers do, the latter remaining on the surface of the weft knit.

It will also be noted that the cover obtained with the knit of the invention is much more uniform compared to the textile base materials usually used for the thermobonding interlining. Moreover, during application of the spots of glue on the textile base material, a better catching of the polymer is obtained.

These good results may be explained by the combination of the presence of the loops of effect yarns and of the number of filaments used in these loops as well as their unitary count. Although the weft yarn obtained by the air jet texturization technique seems to present a relatively heterogeneous structure, the loops of the effect yarn not having a uniform radial distribution, finally this heterogeneity is toned down in the manufacture of a weft knit in which the weft yarn represents up to 80% by weight of the knit. The loops of the effect yarn, under the conditions mentioned above, lie, on the one hand, on the two faces of the weft knit and, on the other hand, fill a large part of the spaces between each stitch. This makes it possible to obtain a very great voluminosity of the knit as well as a touch fairly close to that of a knit obtained with the aid of spun yarns of fibers and also a very good cover. It is also the presence of the loops, according to the parameters set forth above, which makes it possible to obtain a very good catching of the spots of glue, which is effected more on the surface.

Thanks to the textile base material of the invention, it is possible to obtain an interlining having a given covering power with the aid of a base material of lower GSM. Moreover, it is possible substantially to reduce the quantity of polymer employed during application of the spots of glue.

The present invention is not limited to the embodiment which has just been described by way of non-limiting example. In particular, according to a variant embodiment, it is possible to use as core yarn a multi-filament synthetic yarn previously texturized in accordance with the false twist technique. Such a core yarn presents a certain elasticity which will be partially found again, despite a certain blockage due to the presence of the effect yarns, in the weft yarn and consequently in the textile base material for thermobonding interlining made, according to the invention, from the air jet texturized weft yarn.

Moreover, it is possible to employ, when manufacturing the weft yarn mentioned above, any type of synthetic yarns, whether they be pre-drafted or already drafted, it being understood that the term "synthetic" is not restrictive but also covers, in the present specification, what is usually called "artificial".

What is claimed is:

1. A base material for thermobonding interlining, constituted by a fabric or a weft knit comprising texturized synthetic yarns, wherein at least the weft of the fabric or of the weft knit is made of synthetic yarns of large voluminosity, obtained by the air-jet texturization technique from at least two multi-filament yarns, namely a first core yarn for 20 to 40% by weight and a second effect yarn for 60 to 80% by weight, the overfeeding of the core yarn being included between 10 and 25% and overfeeding of the effect yarn at least 70%.

2. The textile base material for thermobonding interlining of claim 1, wherein the unitary filaments of the effect yarn have a count of between 1 and 3 decitex.

3. The textile base material for thermobonding interlining of one of claims 1 or 2 wherein, said base material being a weft knit, the percentage by weight of the weft yarn with respect to the warp yarn is at least 80%.

4. The textile base material for thermobonding interlining of one of claims 1 to 3 wherein the core yarn presents a certain extensibility capable of giving the weft yarn obtained a residual extensibility of the order of 10 to 15%.

5. The textile base material for thermobonding interlining of claim 4, wherein the core yarn is a yarn texturized by the false twist technique.

6. The textile base material for thermobonding interlining of claim 4, wherein the core yarn comprises filaments based on elastothane.

* * * * *